US005691873A

United States Patent [19]

Masaki

[11] Patent Number: 5,691,873

[45] Date of Patent: Nov. 25, 1997

[54] APPARATUS TO GENERATE MAGNETISM

[75] Inventor: Kazumi Masaki, Osaka, Japan

[73] Assignee: Ken Hayashibara, Okayama, Japan

[21] Appl. No.: 536,638

[22] Filed: Sep. 29, 1995

[30] Foreign Application Priority Data

Oct. 1, 1994 [JP] Japan ..... 6-260983
Aug. 22, 1995 [JP] Japan ..... 7-234637

[51] Int. Cl.[6] ..... H01F 7/18

[52] U.S. Cl. ..... 361/166; 307/41; 307/110

[58] Field of Search ..... 361/143, 152–156, 361/160, 166, 256, 257; 307/108, 41, 110

[56] References Cited

U.S. PATENT DOCUMENTS

| | | | |
|---|---|---|---|
| 3,931,528 | 1/1976 | Farnsworth et al. | 307/108 |
| 4,011,463 | 3/1977 | Fasching | 307/110 |
| 4,375,594 | 3/1983 | Ewanizky, Jr. | 307/110 |
| 4,549,091 | 10/1985 | Fahlen et al. | 307/106 |
| 4,573,006 | 2/1986 | Newton | 307/110 |
| 4,757,419 | 7/1988 | Masaki . | |

FOREIGN PATENT DOCUMENTS

| | | |
|---|---|---|
| 30 31 659 | 5/1981 | Germany . |
| 59-33155 | 2/1984 | Japan . |

OTHER PUBLICATIONS

Abstract of Japanese Application No. 87/0288900, published 22 May 1989.

Abstract of Japanese Application No. 80/0076426, published 15 May 1982.

*Primary Examiner*—Fritz Fleming

*Attorney, Agent, or Firm*—Browdy and Neimark

[57] ABSTRACT

The present invention is to provide means to attain an improved current efficiency and a stabilized operation even when used to generate high-power magnetic pulses at shortened pulse intervals. The objective is attainable with an apparatus to generate magnetism, comprising a plurality of magnetism-generating circuits which are cascaded each other, each magnetism-generating circuit containing a coil member to generate magnetism and a capacitor to provisionally store the current across said coil member; and a conduction-controlling circuit which is to operate the magnetism-generating circuits in a prescribed order.

6 Claims, 3 Drawing Sheets

APPARATUS TO GENERATE MAGNETISM

BACKGROUND OF THE INVENTION

1. Field of the Invention

The present invention relates to an apparatus to generate magnetism, in particular, to an apparatus to generate magnetism which attains an improved current efficiency, wherein a plurality of magnetism-generating circuits containing capacitor to provisionally store the current across coil member are provided to repeatedly use the current.

2. Description of Prior Art

There has been known an apparatus to generate magnetism where coil member is energized with dc, which uses as shown in FIG. 3, labeled "prior art", only one magnetism-generating circuit consisting of a coil member to generate magnetism, a series circuit containing a capacitor to provisionally store the current through the coil member, a first thyristor having a main current path connected in series with the series circuit, and a second thyristor having a main current path which is connected in parallel with the series circuit in such a manner that the first and second thyristors come into forward direction. Such an apparatus is much more superior in current efficiency to those which have been known previously because it repeatedly uses the current which has been once energized to coil member. This type of apparatus however has the drawbacks that when one use it to generate high-power magnetic pulses, its insufficient current efficiency may increase power consumption per unit of magnetism, as well as that its operation may become unstable as pulse intervals become shorter.

SUMMARY OF THE INVENTION

In view of the foregoing, a main object of the present invention is to provide an apparatus to generate magnetism which attains an improved current efficiency and a stabilized operation even when used to generate high-power magnetic pulses at shortened pulse intervals.

The present invention solves the above described object with an apparatus to generate magnetism, comprising a plurality of magnetism-generating circuits which are cascaded each other, each magnetism-generating circuit containing a coil member to generate magnetism and a capacitor to provisionally store the current across said coil member; and a conduction-controlling circuit which is to operate the magnetism-generating circuits in a prescribed order.

In the apparatus of the present invention, the current which has been energized twice to a coil member in one magnetism-generating circuit is repeatedly used to energize another coil member in a following magnetism-generating circuit. Further by suitably operating the magnetism-generating circuits, one can stably obtain high-power magnetic pulses at shortened pulse intervals.

The present invention will be more concretely explained hereinafter in conjunction with several embodiments which are however not intended in any way to limit the scope of the present invention.

Figure 1:
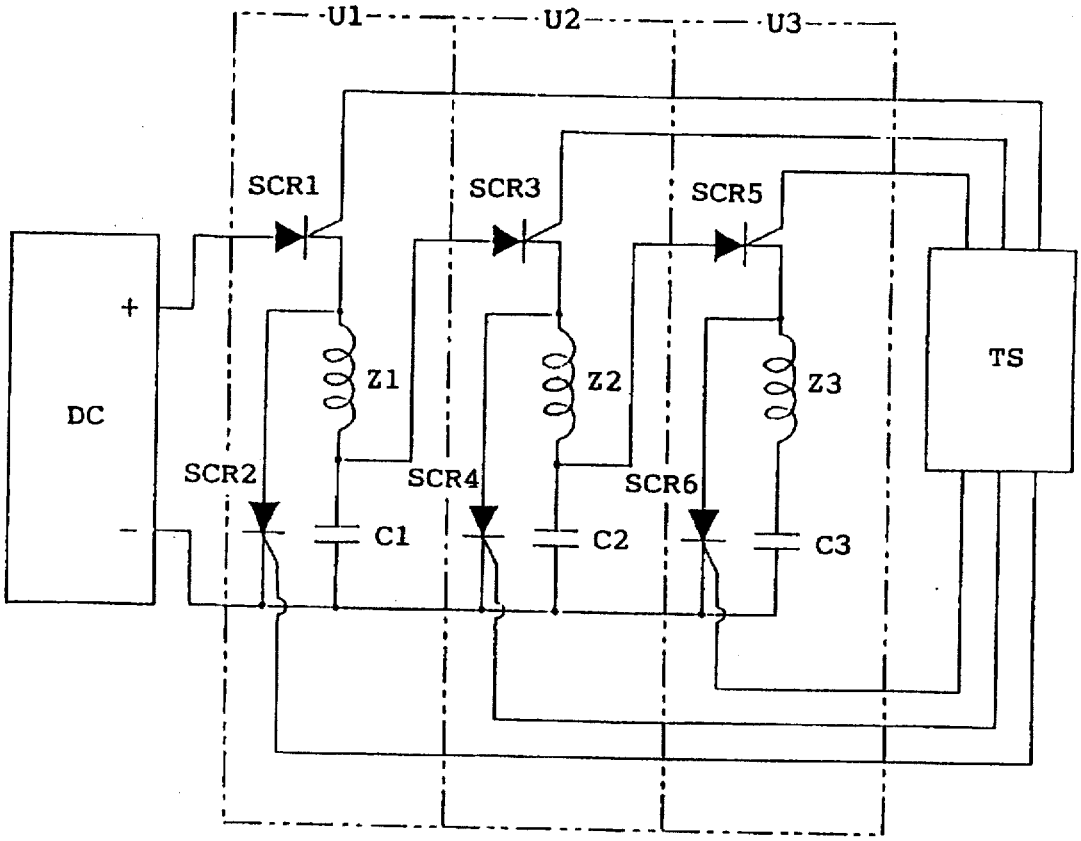
FIG. 1 is a circuit which shows the electric constitutive part in an embodiment according to the present invention.

Throughout the Figures, the symbols or reference numerals U1 through U3 designate magnetism-generating circuits; DC, dc source; SCR1 through SCR6, thyristors; Z1 through Z3, coil members; C1 through C3, capacitors; TS, conduction-controlling circuit; A, A', B, B', C and C', waveforms across coil members Z1, Z2 and Z3 respectively; 1, circular member; 2, wire; 3, projected part; 4, heat-insulating material; 5, bimetal; and K, lead.

DETAILED DESCRIPTION OF THE INVENTION

FIG. 1 is a circuit which shows the electric constitutive part in an embodiment according to the present invention. In the Figure, DC is a dc source which usually comprises a rectifier circuit having an input terminal connected with an ac source, and a smoothing circuit which is connected with an output terminal of the rectifier circuit to smooth and convert its output into dc. U1, U2 and U3 are magnetism-generating circuits and respective circuits comprise a series circuit of coil member Z1, Z2 or Z3 to generate magnetism and a capacitor C1, C2 or C3, a first thyristor SCR1, SCR3 or SCR5 having a main current path connected in series with the series circuit, and a second thyristor SCR2, SCR4 or SCR6 having a main current path which is connected in parallel with the first thyristor SCR1, SCR2 or SCR3 in such a manner that the first and second thyristors come into forward direction.

The hot terminal of the dc source DC is connected with one terminal of the main current path of the first thyristor SCR1 in the magnetism-generating circuit U1, while the cold terminal as the return terminal is connected with the terminals of the capacitors C1, C2 and C3 in the magnetism-generating circuits U1, U2 and U3 and also with the terminals of the second thyristors SCR2, SCR4 and SCR6 having main current paths which are connected in parallel with the first thyristors SCR1, SCR3 and SCR5 in such a manner that the first and second thyristors come into forward direction.

One terminal of the main current path of the first thyristor SCR3 in the magnetism-generating circuit U2 is connected between the coil member Z1 and capacitor C1 in the preceding magnetism-generating circuit U1, while one terminal of the main current path of the first thyristor SCR5 in the magnetism-generating circuit U3 is connected similarly between the coil member Z2 and capacitor C2 in the preceding magnetism-generating circuit U2. Thus in this embodiment the magnetism-generating circuits are cascaded each other so that the current which has been energized once to the coil member Z1 can be further energized to the following magnetism-generating circuits U2 and U3. The gates of the first and second thyristors SCR1 through SCR6 in the magnetism-generating circuits U1, U2 and U3 are connected with an output terminal of a conduction-controlling circuit TS.

In summary, the present invention comprises a plurality of magnetism-generating circuits, each circuit comprising a coil member which is to generate magnetism, a series circuit containing a capacitor which is to provisionally store the current across said coil member, a first thyristor which has a main current path connected in series with said series circuit, and a second thyristor having a main current path which is connected in parallel with said series circuit in such a manner that said first and second thyristors come in forward connection each other, wherein one terminal of the capacitor in each magnetism-generating circuit is connected with the return terminal of a dc source and one terminal of the main current path of the first thyristor in one magnetism-generating circuit is connected with an output terminal of said dc source, while in the remaining magnetism-generating circuits, one terminal of the first thyristor in each magnetism-generating circuit is connected between the coil member and capacitor in the preceding magnetism-generating circuit so that a conduction-controlling circuit which has an output terminal connected with the gates of the first and second thyristors in the following magnetism-generating circuit can bring them into conduction with the current across the coil member in the preceding magnetism-generating circuit.

Now explaining the operation of this embodiment, when the dc source is ON and triggering signals from the conduction-controlling circuit TS are energized to the gate of the first thyristor SCR1 in the magnetism-generating circuit U1, a current flows from the dc source DC to the coil member Z1 through the main current path of the first thyristor SCR1. The waveform of the current across the coil member Z1 is as shown in FIG. 2(A). The current which has been energized to the coil member Z1 charges the capacitor C1 and the conduction of the thyristor SCR1 is suspended when the voltage across the capacitor C1 exceeds a prescribed level. Then triggering signals from the conduction-controlling circuit TS are energized to the gate of the first thyristor SCR3 in the magnetism-generating circuit U2 and approximately at the same time triggering signals are energized to the gate of the second thyristor SCR2 in the magnetism-generating circuit U1. The charge which is present in the capacitor C1 at this time is energized to the coil member Z2 through the main current path of the first thyristor SCR3, then stored in the capacitor C2. The waveform of the current across the coil member Z2 is as shown in FIG. 2(B). When the voltage across the capacitor C2 becomes equal to that across the capacitor C1, the thyristor SCR3 is brought into nonconduction.

In the same way, triggering signals are subsequently energized to the gate of the first thyristor SCR5 in the magnetism-generating circuit U3 and approximately at the same time triggering signals are energized to the gate of the second thyristor SCR4 in the magnetism-generating circuit U2. The charge which has been stored in the capacitor C2 during this operation is energized to the coil member Z3 through the main current path of the first thyristor SCR5, then stored in the capacitor C3 for repeated use. The waveform of the current across the coil member Z3 is as shown in FIG. 2(C).

Figure 2:
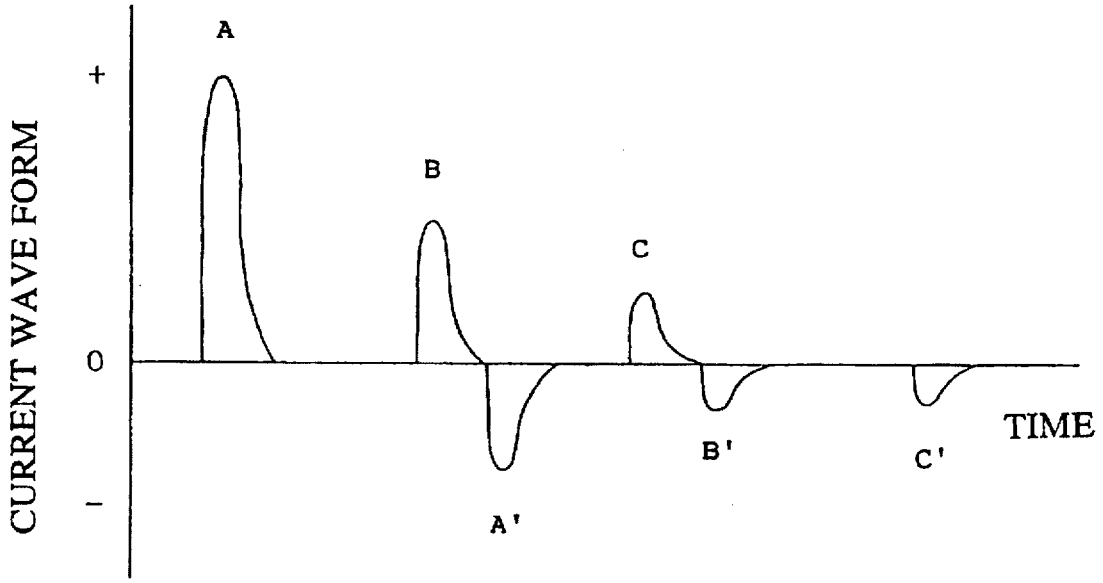
FIG. 2 shows the waveforms across coil members Z1, Z2 and Z3.
Figure 3:
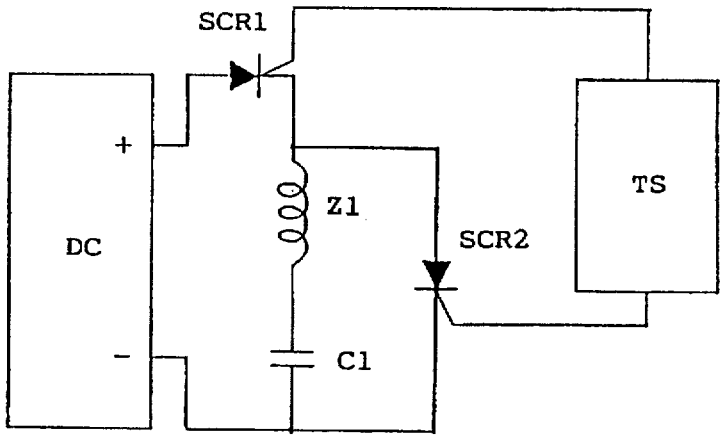
FIG. 3 (PRIOR ART)
FIG. 3 is a circuit which shows the electric constitutive part in conventional apparatus to generate magnetism.

Thus, waveform B—the current across coil Z2—is immediately followed by waveform A', the reverse current across the coil member Z1, as seen in FIG. 2. The charge stored in C1 first flows through Z2 (shown by curve B) while SCR3 is closed. Then, after SCR3 is open, the current leaving C1 passes through Z1. This is current A'. Similarly, waveform B' follows waveform C after SCR5 goes non-conducting. Lastly, when TS activates SCR6, waveform C' is the result.

Thus, by allowing the conduction-controlling circuit TS to successively operate the magnetism-generating circuits U1, U2 and U3, a forward current and a diphasic current as shown in FIG. 2 whose magnitude declines in time course continually flow into the coil members Z1, Z2 and Z3, thus generating a magnetism which has a waveform correspondent to those of the input currents. By allowing the conduction-controlling circuit to repeat the above described operation, the coil members Z1, Z2 and Z3 continuously generate a series of magnetic pulse which has such a waveform. Although this embodiment does not describe concretely, by suitably operating the conduction-controlling circuit TS, one can obtain series of pulses of different types which consist of magnetic fields of one direction, those of opposite directions or combination thereof. Further the number of the magnetism-generating circuits are not restricted to three and four or more circuits can be used, provided that coil members with low dc resistance values are used.

Figure 4:
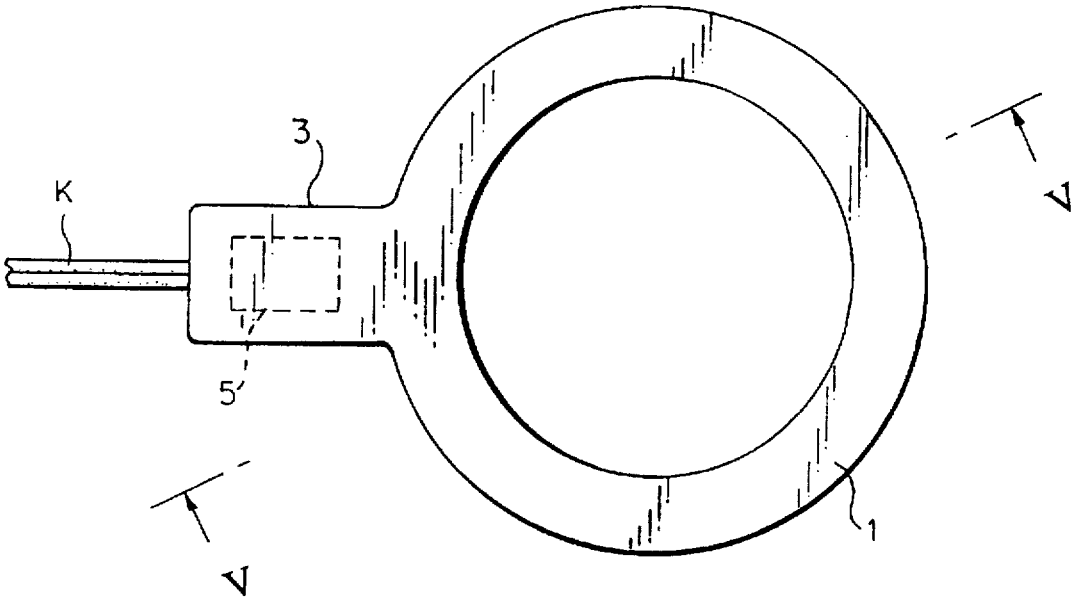
FIG. 4 is a top plane view of a coil member.
Figure 5:
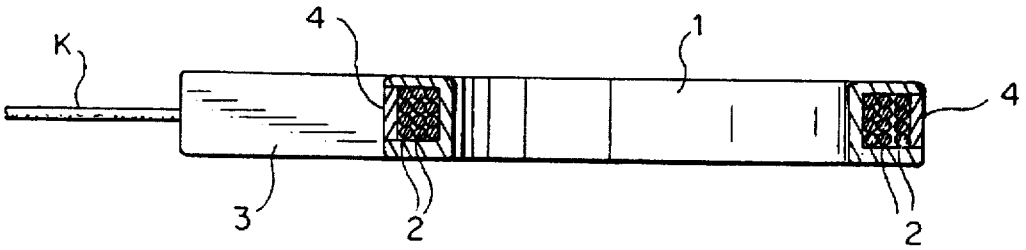
FIG. 5 is a side elevation view cut off along with the line V—V in FIG. 4.

There are provided no limitations in the shapes and structures of coil members as far as they generate a prescribed magnetism. However when used in magnetic therapy for human subjects, it is preferable to prepare coil members into shapes and structures which allow subjects to easily attach to desired sites, as well as reducing their possible fatigue at the sites to be treated due to the weight of coil members. FIGS. 4 and 5 show an example of coil member which is useful in magnetic therapy for human subjects: FIG. 4 shows its top plane view, while FIG. 5, the side elevation view cut off along with the line V—V in FIG. 4. In FIGS. 4 and 5, the reference numeral 1 designates a circular member which is prepared for respective subject's sites to be treated by forming plastic materials to suitable sizes. There is provided as shown in FIG. 5 a groove along with the fringe of the circular member 1 and a wire 2 is wound many times along with the groove.

The materials for the wire are usually copper, silver, aluminum or aluminum alloy which are covered with suitable insulating materials. Among these materials, light metals such as aluminum and aluminum alloy are preferable because they give coil members with remarkably decreased weights which would hardly cause fatigue even when used in magnetic therapy for human subjects. In a projected part 3 provided outside the circular member 1, a bimetal thermostats is enclosed and the winding ends of the wire 2 are connected with a lead K through the bimetal. As well known, bimetals comprise a temperature-sensing part and a switching part which operable in response to the temperature-sensing part. By providing the temperature-sensing part closely to a coil member to generate magnetism and inserting the switching part in the electric circuit including the coil member, one can prevent the coil member to overheat above a prescribed temperature during operation.

In this example, as shown in FIG. 5, the outside of the coil member is coated with a heat-insulating material such as plastic, glass fiber cloth or silicone rubber. This arrangement effectively prevents burns in subjects even when the coil member is overheated to some extent during operation.

As explained above, this invention is superior in current efficiency and capable of stably generating high-power magnetic pulses at shortened pulse intervals because this invention uses a plurality of magnetism-generating circuits and operates them in a successive manner whereby currents which have been used once to energize coil members can be repeatedly used. The use of coil members with low resistances arises no remarkable voltage drops and much more improves current efficiency. The magnetism-generating apparatus of the present invention is useful as magnetism-generating means for any application employing the magnetic pulses so produced. Insofar as magnetism affects living matter, the present invention is applicable in magnetic therapy, as well as in the improvement of productivity of animals and plants, for example, domestic animal, poultry, microorganism, cell, fruit plant, flower and vegetable.

I claim:

1. An apparatus to generate magnetism, comprising (a) a plurality of cascaded magnetism-generating circuits, each of the magnetism-generating circuits further comprising:

a series circuit including a coil member to generate a magnetic field, a capacitor to provisionally store the current through said coil member, and a first thyristor, said series circuit comprising a first main current path; and a second thyristor comprising a second main current path which is connected in parallel with said series circuit in such a manner that said first thyristor and said second thyristor are aligned with each other in a forward direction;

(b) a conduction-controlling circuit comprising means to operate the magnetism-generating circuits in a prescribed order.

2. The apparatus according to claim 1, wherein the apparatus comprises means for coupling to a dc source having a dc output terminal and a dc return terminal, and wherein in a first one of the magnetism-generating circuits, one terminal of the capacitor is coupled with the dc return terminal and one terminal of the first thyristor is connected with the dc output terminal of said dc source, and wherein in each of the remaining magnetism-generating circuits, the first thyristor is connected between the coil member and a preceding capacitor in a preceding one of the magnetism-generating circuits, and wherein the conduction-controlling circuit includes an output terminal connected with gates of the first thyristor and the second thyristors in a following magnetism-generating circuit, and includes means to bring them into conduction with the current across the coil member in the preceding magnetism-generating circuit.

3. The apparatus according to claim 1, wherein a pair of respective coil members of the magnetism-generating circuits are disposed to generate opposing respective magnetic fields when energized.

4. The apparatus according to claim 1, wherein said coil members comprise aluminum or aluminum alloy.

5. The apparatus according to claim 1, comprising a switching and temperature-sensing means for preventing overheating of any coil member above a prescribed temperature during operation, said temperature-sensing means being disposed closely adjacent the coil member.

6. The apparatus according to claim 1, comprising heat-insulating material covering the coil member.

* * * * *